United States Patent [19]

Ersteniuk

[11] Patent Number: 4,975,980

[45] Date of Patent: Dec. 11, 1990

[54] PROTECTIVE HELMET FOR FIREFIGHTERS

[76] Inventor: Stephen R. Ersteniuk, 2395 Titus Ave., Rochester, N.Y. 14622

[21] Appl. No.: 353,962

[22] Filed: May 19, 1989

[51] Int. Cl.[5] ..... A42B 3/00

[52] U.S. Cl. ..... 2/6; 2/172

[58] Field of Search ..... 2/5, 6, 7, 171, 172, 2/181, 184.5, 185 R, 199, 410, 423, 424, 422, 419

[56] References Cited

U.S. PATENT DOCUMENTS

| | | | |
|---|---|---|---|
| 1,179,473 | 4/1916 | Taylor | 2/184.5 |
| 1,492,577 | 5/1924 | Obermeyer | 2/172 |
| 1,532,750 | 4/1925 | Joha | 2/172 |
| 2,250,275 | 7/1941 | Riddell | 2/424 |
| 2,462,258 | 2/1949 | Dannenberg | 2/199 |
| 2,758,306 | 8/1956 | Grancsay | 2/419 |
| 2,897,510 | 8/1959 | Robinson | 2/172 |
| 3,046,560 | 7/1962 | DeGrazia | 2/6 |
| 3,100,896 | 8/1963 | Khanbegian | 2/6 |
| 3,825,952 | 7/1974 | Pershing | 2/422 |
| 3,956,447 | 5/1976 | Denommee | 2/6 |
| 4,573,217 | 3/1986 | Reed | 2/7 |
| 4,829,599 | 5/1989 | Giorgio | 2/423 |

FOREIGN PATENT DOCUMENTS

| | | | |
|---|---|---|---|
| 87037 | 3/1959 | Denmark | 2/6 |
| 375369 | 7/1907 | France | 2/172 |
| 139164 | 4/1930 | Switzerland | 2/172 |
| 281414 | 3/1952 | Switzerland | 2/6 |
| 192630 | of 1923 | United Kingdom | 2/6 |

*Primary Examiner*—Werner H. Schroeder
*Assistant Examiner*—Diana L. Biefeld
*Attorney, Agent, or Firm*—Howard J. Greenwald

[57] ABSTRACT

A fire helmet comprised of a helmet shell adapted to receive the head of a wearer and fit over the crown of the head of the wearer, a radially, inwardly-spaced liner attached to the inside of said helmet shell, a headband attached to said liner, fire-resistant ear flaps secured to said liner, and a fire-resistant, disengagable hood permently secured to said headband.

18 Claims, 3 Drawing Sheets

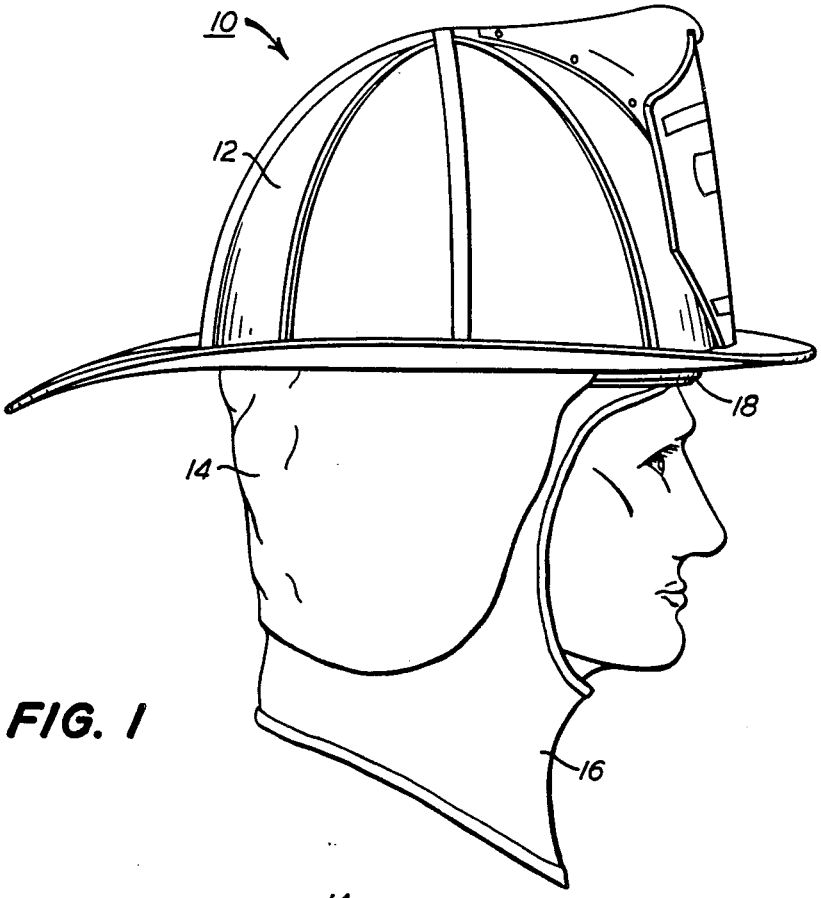
FIG. 1
FIG. 2
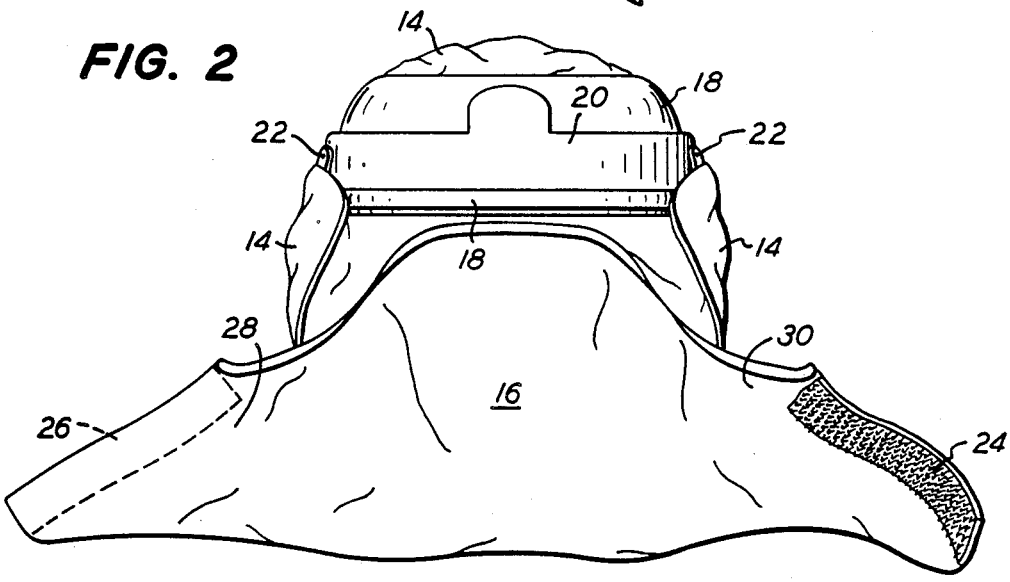

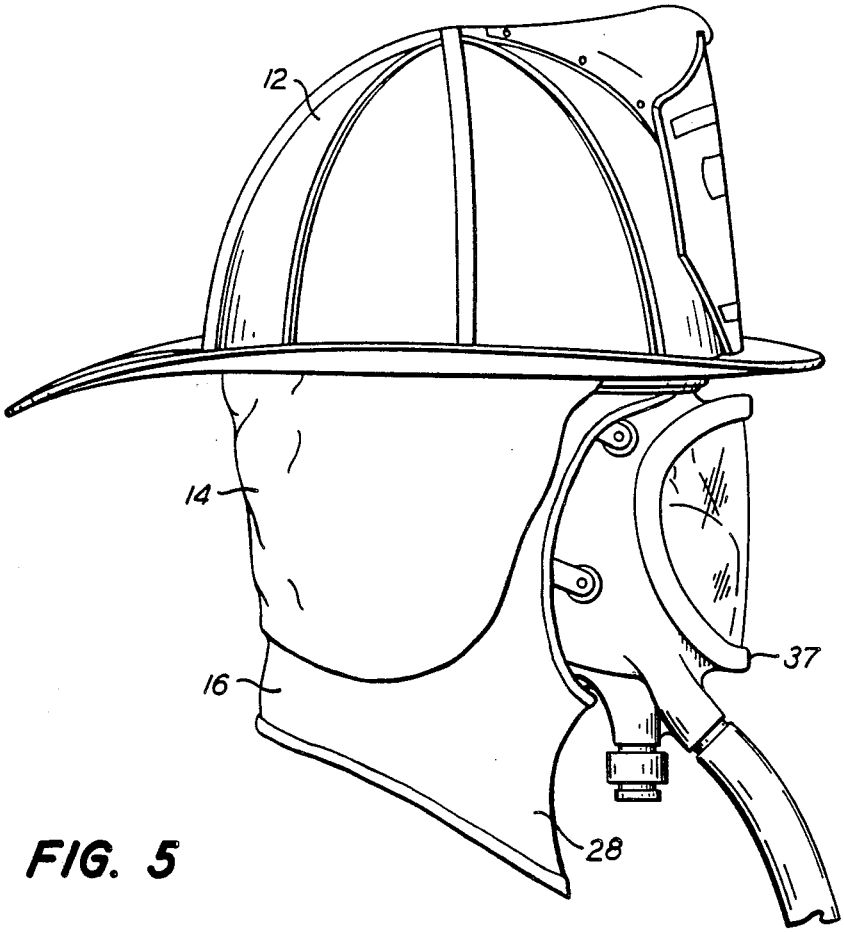
FIG. 5
FIG. 6
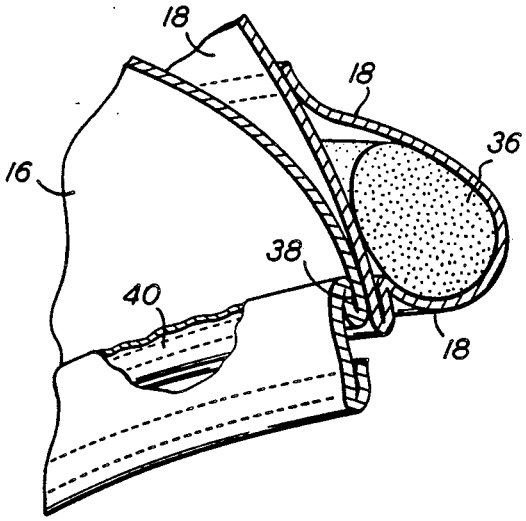

PROTECTIVE HELMET FOR FIREFIGHTERS

FIELD OF THE INVENTION

A lined fire helmet containing flame retardant ear flaps attached to the helmet liner, and a flame-retardant, adjustable, disengagable hood permanently attached to the helmet liner headband.

DESCRIPTION OF THE PRIOR ART

There are about 1,500,000 volunteer firefighters in the United States, about the same number as existed twenty years ago. However, because there are more communities, the number of firefighters per community is less. See, e.g., the Apr. 19, 1987 issue of the New York Times entitled "Ranks of Volunteer Firefighters Thinned by Changing Society."

It appears as though people in American society are more mobile and less community minded. Although about ninety percent of all firefighters are volunteers, some of these volunteers are now requesting compensation for their services.

One means of inducing people to volunteer as firefighters is to provide them with equipment which is easy to use, comfortable, and safe. Unfortunately, some of the prior art fire helmets do not meet all of these needs.

Prior art fire helmets often are not sufficiently warm. Prior art fire helmets often do not provide a one-piece unit with which the wearer can get dressed and undressed readily. Furthermore, when some of the prior art fire helmets are involved in entanglements such as, e.g., debris from a fire, they are not readily and spontaneously disengagable from the neck of the wearer and, thus, are likely to injure the wearer.

It is an object of this invention to provide an improved fire helmet which overcomes the problems presented by prior art fire helmets and flame retardant hoods.

SUMMARY OF THE INVENTION

In accordance with this invention, there is provided a fire helmet comprised of a helmet shell adapted to receive the head of a wearer and fit over the crown of the head of the wearer, a radially, inwardly-spaced liner attached to the inside of said helmet shell, a headband attached to said liner, fire-resistant ear flaps secured to said liner, and a fire-resistant, disengagable hood permanently secured to said headband. The ear flaps of this device are attached to said liner so that they extend downwardly therefrom sufficiently below the head portion of the helmet to cover the ears and at least a portion of the neck of the wearer. The hood is comprised of a fire-resistant head portion adapted to cover the forehead and the ears of the wearer, a fire resistant lower marginal portion extending sufficiently below the head portion to cover the lower neck of the wearer, and at least two fire resistant flaps permanently attached to the head portion and the lower marginal portion at one end of said flaps, wherein said flaps extend sufficiently below the head portion to cover the chin and the neck of the firefighter. Each of the two fire resistant flaps contain non-metallic and fire resistant means for adjustably and releasably fastening a portion of one of the flaps to a portion of another of the flaps.

DESCRIPTION OF THE DRAWINGS

The present invention will be more fully understood by reference to the following detailed description thereof, when read in conjunction with the attached drawings, wherein like reference numerals refer to like elements and wherein:

FIG. 1 is a side perspective view of the fire helmet device of the invention in use on a wearer's head with the helmet's disengagable hood in its down position;

FIG. 2 is a perspective view of the disengagable hood used in applicant's invention which is attached to the headband of the helmet liner;

FIG. 5 is a side perspective view of the fire helmet device of this invention being used in conjunction with a self-contained breathing apparatus; and FIG. 6 is a partially broken away, perspective view of one means of fastening the hood of the helmet device to the headband of the device.

DESCRIPTION OF THE PREFERRED EMBODIMENTS

Figure 3:
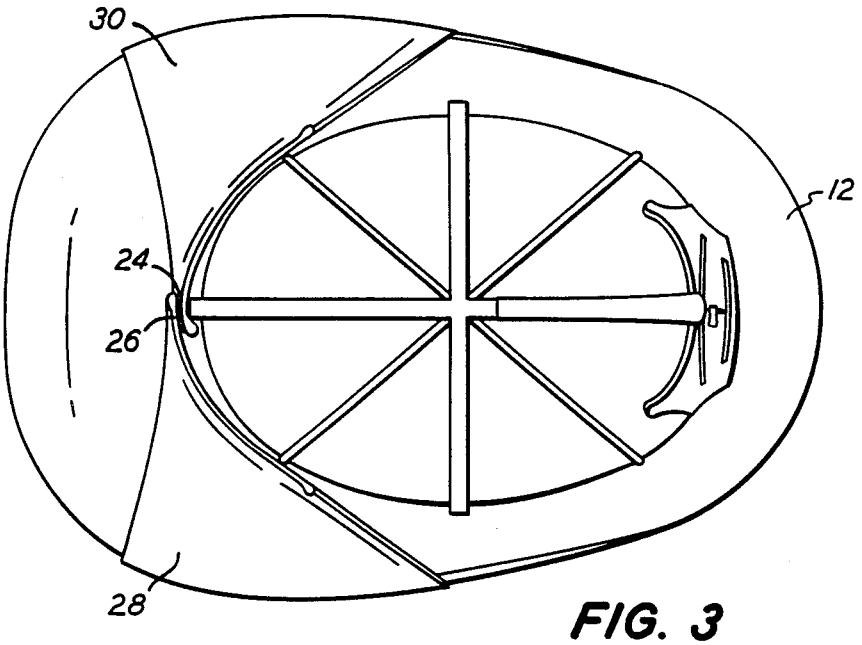
FIG. 3 is a top view of the helmet of FIG. 1 showing it with the disengagable hood in its stored position.

The figures describe one of the preferred embodiments of applicant's invention. Referring to FIG. 1, applicant's device 10 is comprised of lined fire helmet 12, flame-retardant ear flaps 14 attached to the liner, and a flame-retardant, disengagable hood 16 permanently attached to the headband (not shown) of the liner (not shown) of the helmet.

The term lined fire helmet, as used in this specification, refers to a helmet comprised of a body portion and a suspension system within and attached to said body portion; the suspension system is often referred to as a liner by those skilled in the art, and a helmet with such a system in it is often referred to as a lined fire helmet. As is known to those skilled in the art, such suspension/liner is generally comprised of straps and/or cushions; the system is designed to protect the wearer's head from impact and/or the effects of fire. The headband of this invention, and the earflaps of the invention, are preferably attached to the suspension system of the fire helmet.

The body portion and the suspension of the fire helmet may be constructed of materials well known to those skilled in the art. Thus, by way of illustration, the shell of the fire helmet may be constructed of fiberglass, phenolic resin, leather, polycarbonate resins such as "LEXAN" (sold by the General Electric Company, Polymers Product Department, Pittsfield, Mass.), and the like; it is preferred that the material used meet or exceed the requirements of "NFPA" (National Fire Protection Association) Standard 1972. the disclosure of which is hereby incorporated by reference into this specification. In one preferred embodiment, thermoplastic carbonate-linked polymers produced by reacting bisphenol A with phosgene may be used to construct the helmet. Any of the linings known to those skilled in the art may be used in the fire helmet as long as they meet or exceed the requirements of NFPA 1972.

In the device of this invention, the suspension/liner is preferably attached to the inside of the body portion of the fire helmet 12. Conventional means for making such attachment are well known to those skilled in the art. Thus, by way of illustration, the suspension may be secured to the interior body portion of the helmet by means of "VELCRO" snaps, buttons, tongue and groove snaps, and other fastening means well known to those skilled in the art. Any shape and/or type of the suspended fire helmets well known to those skilled in the art may be used in applicant's device. Thus, by way of illustration and not limitation, one may use a helmet comprised of a body portion, a suspension within said body portion, lining within said body portion, a retainer band having a cushion portion, and a flap extending upwardly from said cushion portion and secured to such lining to loosely suspend the cushion portion; see, e.g., U.S. Pat. No. 1,492,577 of Obermeyer. Thus, e.g., one may use a military type helmet which is supported upon the head of the wearer by a radially inwardly spaced headband; e.g., U.S. Pat. Nos. 2,250,275 of Ridell, 2,758,306 of Grancsay et al., and 3,100,896 of Khanbegian. Thus, e.g., one may use the rigid helmet shell dimensioned to receive the head of the wearer and to extend over the crown of the head for protecting the crown of the head from impacts which is described in U.S. Pat. No. 3,535,706 of Aileo. Thus, e.g., one may use a helmet having a substantially circular opening for permitting the ingress or egress of a wearer's head therein, said helmet being so constructed and arranged that the opening is disposed so as to encircle the upper neck portion of a wearer of the helmet.; see, e.g., U.S. Pat. No. 3,825,952 of Pershing et al. Thus, e.g., one may use the helmet disclosed in U.S. Pat. No. 4,573,217 of Reed. The disclosure of each of the aforementioned patents is hereby incorporated by reference into this specification.

The aforementioned lined fire helmets are readily available to those in the art. Thus, by way of illustration, one may use fire helmets available from: the E.D. Bullard Company of 2680 Bridgeway, Sausalito, Calif. (which sells a plastic fire helmet), the Morning Pride Mfg. Inc. of 1986 Home Avenue, Dayton, Ohio, the Wheeler Protective Apparel, Inc. of 4330 W. Belmont Avenue, Chicago, Ill. (which sells a fiberglass fire helmet), the Mine Safety Appliances Co. of P.0. Box 426, Pittsburgh, Pa. (which sells a phenolic fire helmet), and the Cairns & Brother Company, 60 Webro Road, P.0. Box 49076, Clifton, N.J.

The Cairns and Brothers Mar. 31, 1988 "Helmets & Accessories Price List," the disclosure of which is hereby incorporated by reference into this specification, describes many of the lined fire helmets available to those in the art. Thus, the "990 Intruder" model has a 100 percent "KELVAR" outer shell and a urethane impact liner with a suspension system. The "660C Metro" model has a high-temperature composite fiberglass shell and an adjustable cushion liner with "NOMEX" earflaps. The "660 Phoenix" model has a thermoplastic shell and an adjustable cushion liner with "NOMEX" earflaps. The "N5A New Yorker" model has a leather outer shell and a cushion liner with "NOMEX" earflaps.

The linings used in the lined fire helmets are well known to those in the art. Thus, e.g., one may purchase from the aforementioned Cairns and Brother price list an adjustable sweat liner with or without "NOMEX" earflaps, an adjustable cushion liner with or without "NOMEX" earflaps, an impact cap/suspension system, and the like. As is known to those skilled in the art, the linings may be of different shapes, sizes, and materials.

One of the preferred fire helmets is disclosed in FIG. 1. As is illustrated in this Figure, device 10 is comprised of lined fire helmet 12, ear flaps 14, and disengagable hood 16.

Ear flaps 14 are attached to lined fire helmet 12. Although these ear flaps may be secured directly to the body of the helmet, it is preferred to secure them to the liner (not shown) of the helmet 12. Other means of securing the ear flaps to the lined body helmet include, e.g., stitching, sewing, the use of "VELCRO" type fasteners, and the like. In one preferred embodiment, ear flaps 14 are stitched to the liner of the helmet so that they extend downwardly therefrom sufficiently below the head portion of the helmet to cover the ears and part or all of the neck of the wearer.

Ear flaps used in fire helmets are well known to those skilled in the art. Thus, for example, U.S. Pat. No. 1,492,577 of Obermeyer describes a helmet comprising a metallic body portion, a lining within the body portion, a retainer band having a cushion portion, a flap extending upwardly from the cushion portion and secured to the lining to loosely suspend the cushion portion, a draw cord passing through the cushion portion, and a head apron shaped to provide two flaps 39 adapted to be placed underneath the chin which fully cover the ears. Thus, e.g., earflaps may be purchased from the aforementioned Cairns & Brother price list. One may purchase "NOMEX" earflaps with or without underchin extension, an adjustable sweat liner with "NOMEX" earflaps, and the like.

Although the earflaps 14 may be made of two or more pieces of material, it is preferred that they be one piece of flame-retarded material which is preferably shaped to cover the ears and neck of the wearer.

Referring to FIG. 2, a means of permanently attaching disengagable hood 16 to helmet liner 20 is shown. As is shown in this Figure, headband 18 is permanently attached to helmet liner 20. In the preferred embodiment shown in this Figure, liner 20 is made of plastic. Liner 20 is preferably secured to the inside of helmet 12 by tongue and groove snaps (not shown), although other conventional means of securing the liner to the helmet may be used.

Disengagable hood 16 is attached to headband 18. Headband 18 may be constructed of materials well known to those skilled in the art such as, e.g., fabric which may be flame-retardant. In one embodiment, the headband 18 consists essentially of fabric which is sufficiently flame retardant so that it can pass NFPA Standard 1972. The disengagable hood 16 is secured to headband 18 by conventional means such as, e.g., sewing it to the headband.

Referring again to FIG. 2, flame-retarded earflaps 14 are attached to liner 20 by conventional means such as snaps 22. In the embodiment illustrated in FIG. 2, disengagable hood 16 contains male "VELCRO" portion 24 and female "VELCRO" portion 26 (shown by dotted lines) which can be used to close the hood 16 and protect the wearer's head and neck. As will be apparent to those skilled in the art, "VELCRO" portions 24 and 26 can be attached to hood 16 by conventional means (such as sewing) so that they are suitable for either one who is right-handed or one who is left-handed. In the embodiment shown in FIG. 2, a left-handed device is illustrated. If the orientations of portions 24 and 26 were reversed, a right-handed device would result.

In this embodiment, one or more of the lining of the helmet, ear flaps 14, and/or disengagable hood 16 consist essentially of fire resistant material. In another preferred embodiment, both the ear flaps 14 and the disengagable hood 16 consist essentially of fire resistant material. As used in this specification, the term fire resistant material refers to material which is sufficiently flame retardant that it can meet or exceed NFPA Standards 1971 or 1972, the disclosures of which are hereby incorporated by reference into this specification. Such fire resistant material is well known to those skilled in the art. Thus, e.g., such material may contain a fire-retardant compound such as, e.g., those described on page 1570 of "Best's Safety Directory," Volume 1 (A.M. Best Company, Oldwick, N.J., 1988). Thus, e.g., such material may consist essentially of fabric made from 100 percent fiberglass yarn; see, e.g., page 1570 of the Best's Directory. Thus, e.g., such material may contain plastic-coated fabric; see page 1571 of the Best's Directory. Thus, e.g., material used in the lining and/or the earflaps and/or the hood may be rendered flame-retardant by treating it with phosphoric acid and urea and thereafter curing it at high temperature. Thus, e.g., the material may be flame-retardant by treating it with tetrakis (hydroxymethyl) phosphonium chloride.

In one preferred embodiment, the flame-retardant material is a textile material consisting of fiber selected from the group consisting of man-made fiber, natural fiber, and mixtures thereof. Suitable man-made fibers include regenerated cellulose, cellulose diacetate, cellulose triacetate, polyamide, polyacrylic, polyvinyl, polyolefin, and inorganic fibers. Suitable natural fibers include cotton, jute, wool, kenaf, sisal and other agaves, flax, hemp, abaca, and silk. These fibers are described on pages 263–276 of Volume 5 of the "McGraw-Hill Encylopedia of Science & Technology," (McGraw-Hill Book Company, N.Y., 1977), the disclosure of which is hereby incorporated by reference into this specification. In one preferred embodiment, such flame-retarded material is fabricated from "KELVAR," a trademarked material sold by the E.I. DuPont De Nemours & Company. In another preferred embodiment, such flame retarded material is fabricated from "NOMEX," a trademarked fire-resistant duck type material of the E.I. DuPont De Nemours & Company.

Referring to FIG. 3, a view of the top of helmet 12 is presented. In the embodiment illustrated in FIG. 2, flame retardant, disengagable hood 16 is not in use, and right flap 28 and left flap 30 are fastened to each other on the top of helmet 12 by "VELCRO" fasteners 24 and 26.

As is known to those skilled in the art, the trademark "VELCRO" refers to synthetic materials which adhere when pressed together. The use of "VELCRO" hook and pile fasteners as an adjustable and releasable fastening means is preferred because of the nonconductive and fire resistant qualities of such material. The relationship of fastener 26 to fastener 24 allows a range of adjustability in the fastening of the hood 16. This adjustability is important to allow hood 16 to be used with different head sizes.

FIG. 3 shows two non-metallic and fire-resistant means for adjustably and releasably fastening right flap 28 to left flap 30. In one embodiment, not shown, at least three such means are used. In yet another embodiment, at least four such means are used.

Flame-retarded, disengagable hood 16 is configured so that it will cover the head, forehead and neck of the wearer. Hood 16 is comprised of a fire-resistant head portion adapted to cover the head, forehead and the ears of the firefighter, a fire resistant lower marginal portion extending sufficiently below said head portion to cover the lower neck of the firefighter, and at least two fire resistant flaps permanently attached to said head portion and said lower marginal portion at one end of said flaps, wherein said flaps extend sufficiently below said head portion to cover the chin and the neck of the firefighter. In one embodiment, not shown, the hood is constructed of at least two layers, including an exterior material and an interior material. In one embodiment, the lower marginal portion of the hood and the flaps are sufficiently long so that they may be overlapped by a coat of the firefighter.

Figure 4:
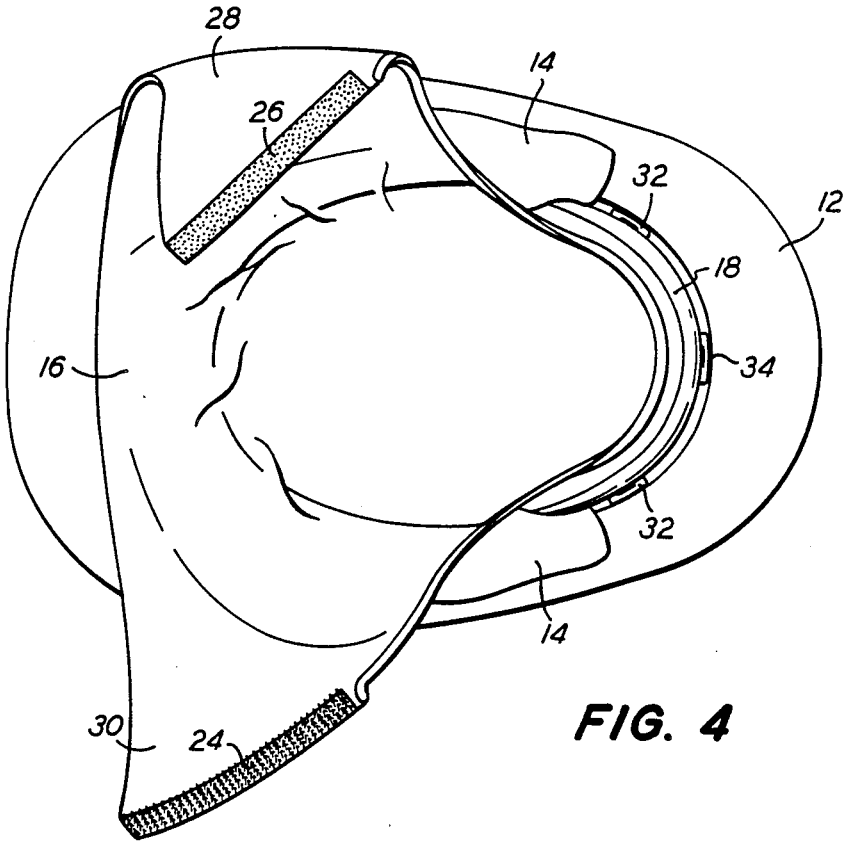
FIG. 4 is a bottom view of the helmet of FIG. 1.

Referring to FIG. 4, a bottom view of the helmet of Figure 1 is shown. Helmet 12 is comprised of ear flaps 14, hood 16, and liner 20 (not shown); headband 18 is shown in this embodiment covering liner 20. In the embodiment illustrated in this Figure, liner 20 (not shown) is attached to helmet 12 by tongue and groove snaps and "VELCRO" fasteners 34. Hood 16 is attached to headband 18 by sewing it thereto, preferably by sewing it into the inside of the headband (see FIG. 6).

FIG. 5 illustrates the use of device 10 together with a self-contained breathing apparatus 37. As is known to those skilled in the art, many different types of self-contained breathing apparatuses (SCBA;s) are commercially available. Thus, such units may be obtained from, e.g., Scott Aviation (Lancaster, N.Y.), Drager Company (West Germany), Mine Safety Appliance Company (Pittsburgh, Pa.), and the like. The user may don the SCBA facepiece, put helmet 12 on his head, disengage flaps 28 and 30 of hood 16, bring said flaps down and around the perimeter of the SCBA facepiece, reengage the hood flaps 28 and 30 underneath his chin via "VELCRO" fasteners 24 and 26, thereby creating a fire protective envelope for the firefighter's entire head, face, and neck and to secure the helmet to the wearer's head without the need for using a chin strap.

FIG. 6 illustrates one means of permanently attaching hood 16 to headband 18. In the embodiment illustrated in this Figure, sweatband 36 is enveloped by headband. The headband 18/sweatband 36 structure is attached to hood 16 at point 38 by sewing the hood to the headband; see, e.g., stitches 40. It is preferred to sew hood 16 to headband 18 around the entire periphery of the headband and the hood.

It is to be understood that the aforementioned description is illustrative only and that changes can be made in the apparatus, the ingredients and their proportions, and in the sequence of combinations and process steps as well as in other aspects of the invention discussed herein without departing from the scope of the invention as defined in the following claims.

I claim:

1. A fire helmet comprised of a helmet shell adapted to receive the head of a wearer and fit over the crown of the head of the wearer, a radially, inwardly-spaced liner attached to the inside of said helmet shell, a headband attached to said liner, fire-resistant ear flaps secured to said liner, and a fire-resistant hood permanently secured to said headband, wherein:

(a) said hood consists essentially of a textile material consisting of fiber selected from the group consisting of man-made fiber, natural fiber, and mixtures thereof;

(b) said headband consists of flame-retardant fabric;

(c) said ear flaps are attached to said liner so that they extend downwardly therefrom sufficiently below the head portion of said helmet to cover the ears and at least a portion of the neck of said wearer;

(d) said hood is comprised of a fire-resistant head portion adapted to cover the crown, forehead, and the ears of the wearer, a fire resistant lower marginal portion extending sufficiently below said head portion to cover the lower neck of the wearer, and at least two fire resistant flaps permanently attached to said head portion and said lower margin portion at one end of said flaps, wherein said flaps extend sufficiently below said head portion to cover the chin and the neck of the firefighter; and (e) each of said two fire resistant flaps of said hood contains non-metallic and fire-resistant means for adjustably and releasably fastening a portion of one of said flaps to a portion of another of said flaps.

2. The fire helmet as recited in claim 1, wherein said helmet shell consists essentially of a material selected from the group consisting of fiberglass, phenolic resin, leather, polycarbonate resin, and mixtures thereof.

3. The fire helmet as recited in claim 2, wherein said helmet shell consists essentially of polycarbonate resin.

4. The fire helmet as recited in claim 3, wherein said polycarbonate resin is a thermoplastic carbonate-linked polymer produced by reacting bisphenol A with phosgene.

5. The fire helmet as recited in claim 2, wherein said helmet shell consists essentially of plastic.

6. The fire helmet as recited in claim 2, wherein said helmet shell consists essentially of fiberglass.

7. The fire helmet as recited in claim 2, wherein said helmet shell consists essentially of phenolic resin.

8. The fire helmet as recited in claim 2, wherein said inwardly-spaced liner is attached to the inside of said helmet shell by tongue and groove snaps.

9. The fire helmet as recited in claim 2, wherein said headband is comprised of a cushion portion.

10. The fire helmet as recited in claim 2, wherein said liner is a urethane impact liner.

11. The fire helmet as recited in claim 2, wherein said liner is an adjustable cushion liner.

12. The fire helmet as recited in claim 2, wherein said headband is permanently attached to said liner.

13. The fire helmet as recited in claim 12, wherein said disengagable hood is sewed to said headband.

14. The fire helmet as recited in claim 13, wherein said helmet shell consists essentially of polycarbonate resin.

15. The fire helmet as recited in claim 14, wherein said polycarbonate resin is a thermoplastic carbonate-linked polymer produced by reacting bisphenol A with phosgene.

16. The fire helmet as recited in claim 14, wherein said inwardly-spaced liner is attached to the inside of said helmet shell by tongue and groove snaps.

17. The fire helmet as recited in claim 16, wherein said non-metallic and fire resistant means consist essentially of synthetic materials which adhere when pressed together.

18. The fire helmet as recited in claim 17, wherein said helmet comprises a sweatband.

* * * * *